United States Patent [19]

Hoenigmann

[11] 3,943,667

[45] Mar. 16, 1976

[54] AUTOMATIC WELD GRINDING MACHINE

[75] Inventor: Gustave Hoenigmann, Ridgewood, N.Y.

[73] Assignee: Acme Steel Door Corporation, Brooklyn, N.Y.

[22] Filed: July 11, 1975

[21] Appl. No.: 595,030

[52] U.S. Cl. ..... 51/112

[51] Int. Cl.[2] ..... B24B 9/04; B24B 21/06

[58] Field of Search..... 51/80 R, 80 A, 110 R, 112, 51/138, 140, 165.76

[56] References Cited

UNITED STATES PATENTS

| | | | |
|---|---|---|---|
| 2,194,757 | 3/1940 | Klaas et al. | 51/112 |
| 2,705,854 | 4/1955 | Lauerdisse | 51/112 |
| 2,787,871 | 4/1957 | LeClercq | 51/110 |
| 3,468,071 | 9/1969 | Woodward | 51/112 |

*Primary Examiner*—Othell M. Simpson

*Attorney, Agent, or Firm*—Kane, Dalsimer, Kane, Sullivan and Kurucz

[57] ABSTRACT

A device for grinding longitudinal welds in a steel door or the like is provided. The device includes a bed for receiving the door and means for moving the door along the bed on a path between opposed grinding wheels. One of the grinding wheels is fixed and the other is mounted to a carriage designed to move transversely to the bed. Switches actuated by the door activate the grinding wheels and moving means. The carriage includes means to limit its movement to insure a proper engagement with the door and the grinding wheels are set at an angle with respect to the axis of the bed to further insure proper contact.

8 Claims, 8 Drawing Figures

AUTOMATIC WELD GRINDING MACHINE

BACKGROUND OF THE INVENTION

The present invention relates to grinding equipment and more particularly to equipment for use in the simultaneous grinding of opposed surfaces such as the opposite sidewalls of steel doors.

Steel doors have traditionally been formed of two identically formed sheets of steel welded to one another. Each of the sheets comprises a front or rear surface of the door and a partial sidewall between the two. The partial sidewalls are formed with an interlock which must be welded securely along the entire length of the door. Thus, the final step in the door forming process prior to painting is the grinding of the weld bead flush with the remainder of the door.

Heretofore, it has been necessary for the welds to be hand ground, a time consuming and costly process. In view of this, the principal object of the present invention is to provide automatic equipment for effecting the grinding process at a substantial savings in time and money.

SUMMARY OF THE INVENTION

The above and other beneficial objects and advantages are attained in accordance with the present invention by providing an automatic device for grinding the longitudinal welds on a steel door or the like. The device includes a bed for receiving the door and means for moving the door along the bed on a path between opposed grinding wheels. One of the grinding wheels is fixed and the other is mounted to a carriage designed to move transversely to the bed. Switches actuated by the door activate the grinding wheels and moving means. The carriage includes means to limit its movement to insure a proper engagement with the door and the grinding wheels are set at an angle with respect to the axis of the bed to further insure proper contact.

DETAILED DESCRIPTION OF THE PREFERRED EMBODIMENT

Figure 8:
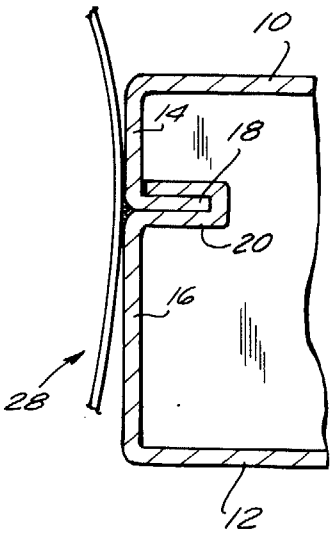
Figure 7:
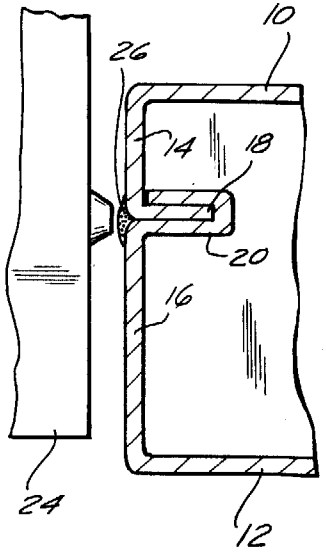
FIG. 7 is a view similar to FIG. 6 after welding but prior to grinding; and, FIG. 8 is a view similar to FIG. 7 after grinding.
Figure 6:
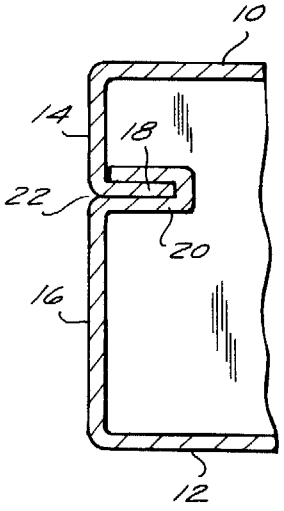
FIG. 6 is a simplified fragmentary sectional view of one sidewall of a door prior to welding.

Reference is now made to the drawings wherein the present invention is depicted. To best understand the environment of the present invention, reference is first made to FIGS. 6 through 8. In FIG. 6 the two steel sheets 10 and 12 are shown forming the front and rear surfaces of a door. Each sheet is bent to define a side portion 14 and 16 respectively and the side portions, in turn, are provided with engaging tabs 18 and 20 which, when interlocked, define a seam 22. As shown in FIG. 7, the seam 22 is secured by welding it utilizing conventional or automatic equipment generally designated by the numeral 24 and resulting in a bead 26. An identical arrangement appears on the opposite side of the door except that the positions of side portions 14 and 16 are reversed thus requiring only a single shape for sheets 10 and 12. As a final step, the bead 26 must be ground flush with the side portions 14 and 16 to produce a smooth, uninterrupted sidewall of the door which may then be painted as desired. The present invention relates to means 28 for effecting the grinding step automatically.

Reference is now made to FIGS. 1 through 5 wherein the automatic grinding device 30 of the present invention is shown. The device 30 comprises a bed 32 formed of a plurality of idle rollers 34 arranged in side by side spaced relation extending across a frame 36. The bed 32 may conveniently be located adjacent to and aligned with welding equipment so that as the door seams are welded, they can be fed to the present device for automatic grinding.

A first grinder 38 is affixed to one side of frame 36 as shown. Grinder 38 comprises a motor 40 driving a shaft 42 to which a grinding wheel 44 is affixed. It should be noted that the motor 40 is pivotally mounted to the frame so that the angle between the grinding wheel 44 and axis of the bed can be varied. It should also be noted that the grinding wheel is not set parallel to the bed but rather at a slight angle.

Figure 1:
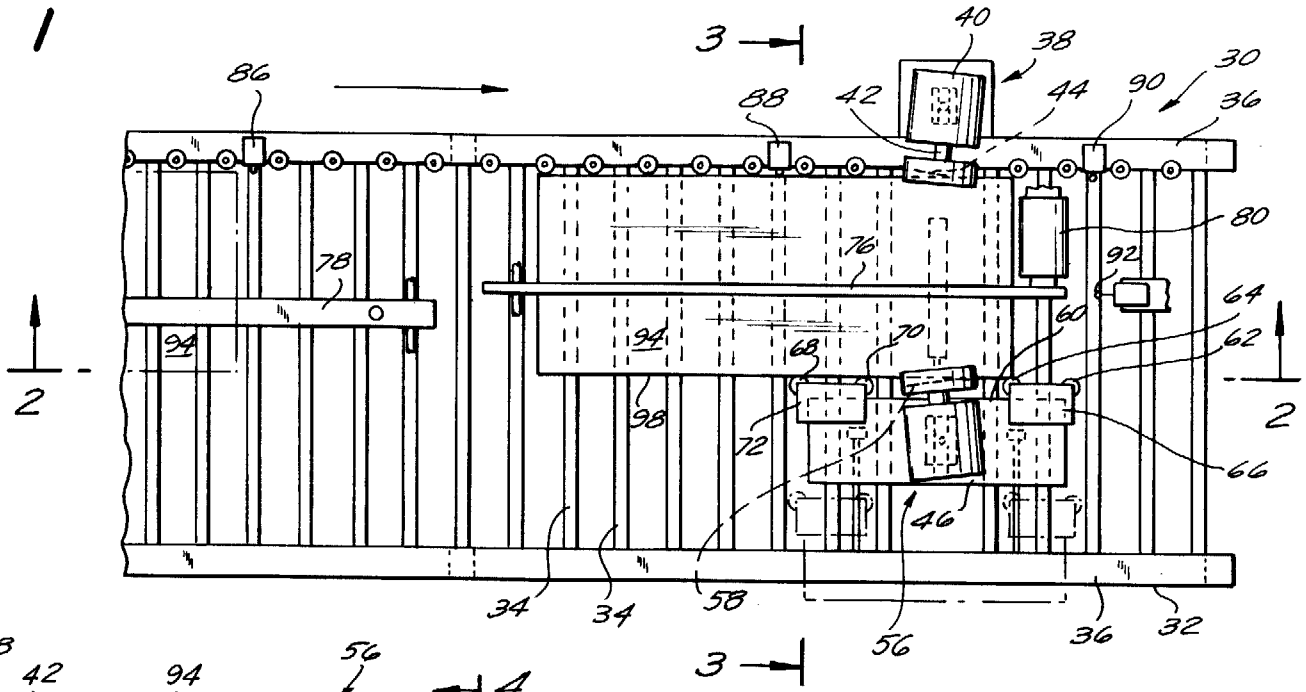
FIG. 1 is a top plan view of an automatic grinding device in accordance with the present invention.
Figure 3:
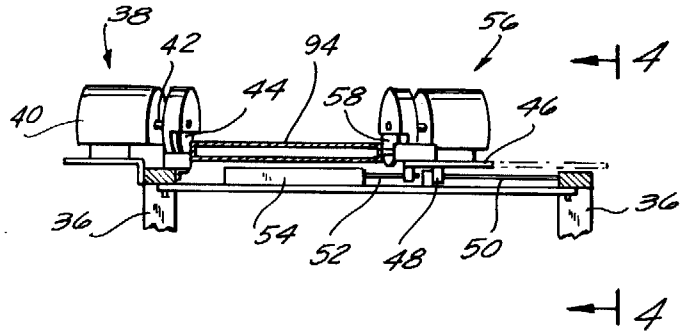
FIG. 3 is a fragmentary sectional view taken along reference lines 3—3 of FIG. 1 in the direction indicated by the arrows.

A carriage 46 is affixed to bed 32 for transverse movement with respect thereto opposite grinder 38. To this end, as shown in FIG. 3, the carriage 46 is mounted through guides 48 onto rods 50 which extend between adjacent rollers 36. The carriage 46 is thus adapted to move along the rods 50 toward and away from the first grinder 38. To this end, the carriage is connected to a piston 52 which extends from cylinder 54 which, in turn, is affixed to the frame. Thus, the carriage moves with the piston in response to an appropriate fluid or gas (such as air) entering and leaving the cylinder.

A second grinder 56 substantially identical with the first grinder 38 is mounted to the carriage for movement with it. In this connection, the second grinding wheel 58 overhangs the inboard edge 60 of the carriage. As with the first grinder, the second grinding wheel is set at a slight angle with respect to the axis of the bed and the angle of the grinding wheels is such that extensions of the planes of the grinding wheels would intersect downstream of the carriage. A first pair of feeler rolls 62, 64 is mounted in a housing 66 affixed to the carriage 46 in front of the second grinder and a second pair of rolls 68, 70 is mounted in a housing 72 behind the grinder. The axis of the feeler rolls 62, 64, 68 and 70 are set transverse to that of the idle rolls 34. It should also be noted that the rolls are spaced slightly back of the grinder.

Figure 2:
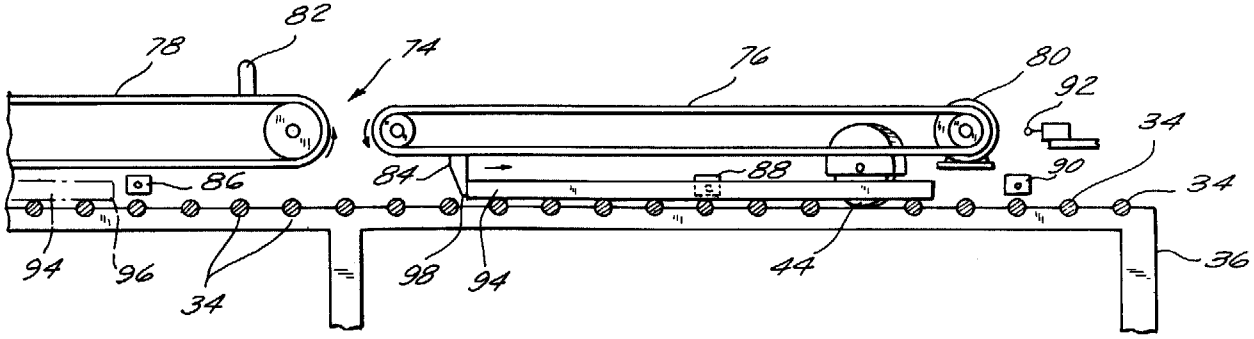
FIG. 2 is a fragmentary sectional view taken along reference lines 2—2 of FIG. 1 in the direction indicated by the arrows.
Figure 4:
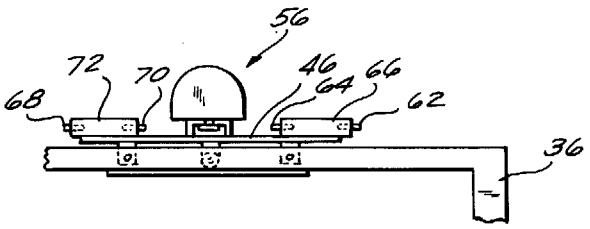
FIG. 4 is a fragmentary end view taken along reference lines 4—4 of FIG. 3 in the direction indicated by the arrows.
Figure 5:
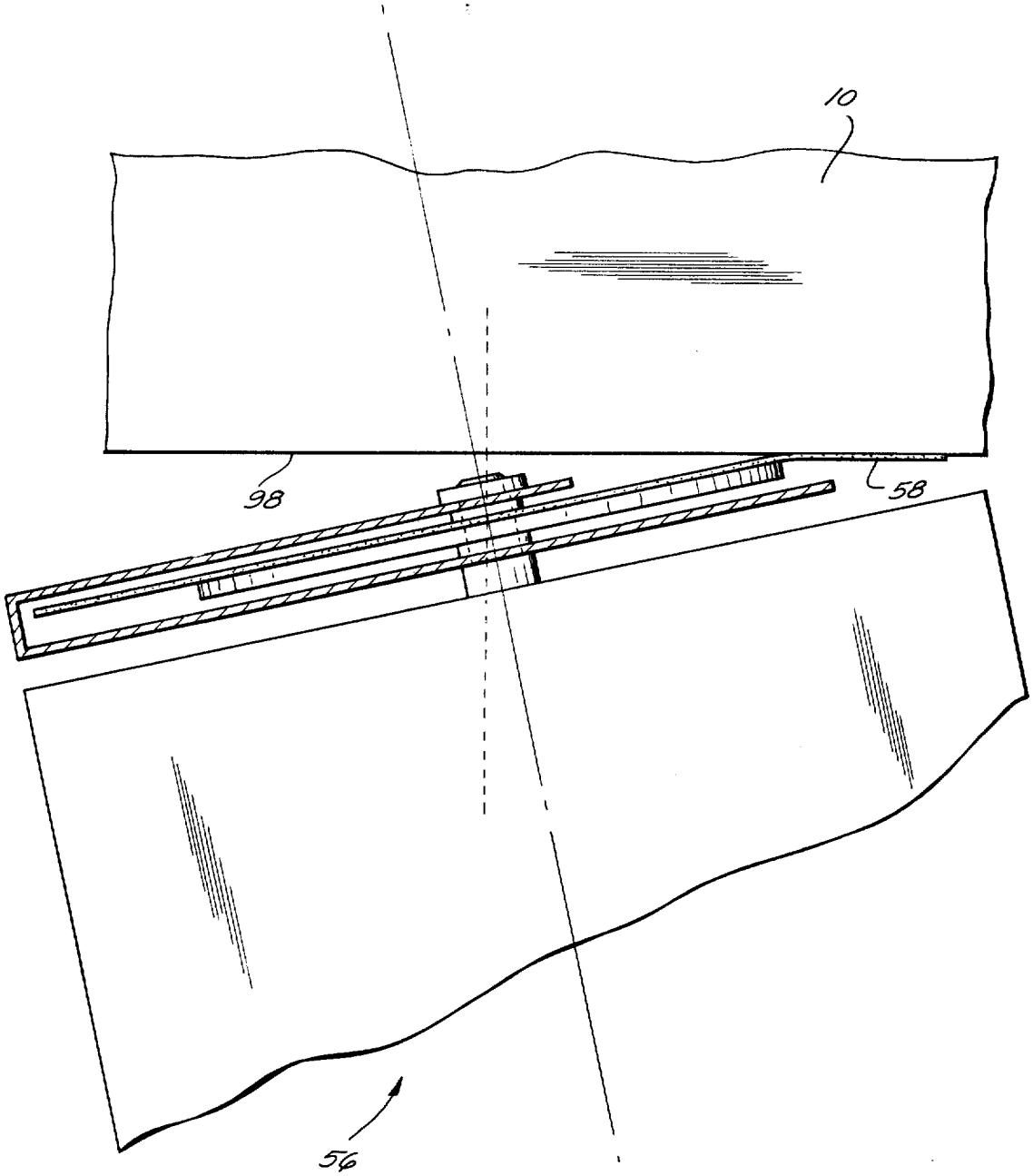
FIG. 5 is an enlarged fragmentary plan view of the grinder utilized in the device of the present invention.

Referring now to FIG. 2, it can be seen that an overhead conveyor 74 is mounted above the bed secured to the frame. The conveyor 74 comprises a first endless chain 76 extending along the bed over the grinders and a second endless chain 78 extending along the bed upstream of the first chain. Each chain is driven by a motor 80 and includes fingers extending toward the bed and adapted to engage a door on the bed and move it along a path past the grinders. Thus, finger 82 extends from chain 78 and finger 84 extends from chain 76.

A series of switches are provided along the bed in the path of a door urged along the bed by the chain fingers. Thus, a first switch 86 is provided along the bed upstream of the first chain 76 as shown. A second switch 88 is provided along the first chain upstream of the grinders and a third switch 90 is provided downstream of the grinders. A fourth switch 92 is spaced above the bed in the path of finger 84 of the first chain so that as the finger passes the switch during each revolution of the chain, switch 92 is activated. The duty of the switches may best be appreciated in connection with the following description of the operation of the present device.

In operation, after a door 94 is welded, it is moved along the upstream portion of the bed by finger 82 of chain 78 engaging and pushing the rear of the door. When the forward end 96 of the door engages the first switch 86 this activates motor 80 to drive chain 76 so that finger 84 will continue to push the door along the bed after finger 82 lifts from the door. Prior to lifting from the door, finger 82 also pushes the door past switch 88 which activates the piston and cylinder to move the carriage inwardly toward the first grinder. The pressure developed in the grinder is sufficient to keep urging the carriage inwardly but not enough to overcome the stop action caused by the feeler rolls 62, 64, 68 and 70 engaging the sidewall 98 of the door. Switch 88 also controls the grinder motors so that both grinders 44 and 58 are kept on so long as the switch is depressed. Switch 90 is connected in parallel with switch 88 so that when either or both of switches 88 and 90 are depressed, the carriage is maintained in position against the door sidewall 98 and the grinders 44 and 58 are kept on. When both switches are released, i.e. when finger 84 pushes the rear end 98 of the door past switch 90, the grinders are turned off and the carriage returns to its initial outward position. In this way, the carriage is ready for the next door regardless of its width. When the finger 84 contacts switch 92, chain motor 80 is shut down.

Thus, it can be seen that the aforementioned objectives are attained by a device in accordance with the above.

Having thus described the invention, what is claimed is:

1. A device for grinding longitudinal welds along the opposed sidewalls of a metal door or the like, said device comprising: a bed for receiving said door and defining a path for said door past first and second grinding means; means for moving said door along said bed; first grinding means affixed to said bed in position to operationally abut one sidewall of said door; carriage means connected to said bed on the opposite side of said door for transverse movement with respect to said bed; second grinding means secured to said carriage for movement therewith; means for moving said carriage; and, means affixed to said carriage for sensing a door and limiting the movement of said carriage to a position wherein said second grinding means operationally abuts the opposite sidewall of said door.

2. The device in accordance with claim 1 further comprising first switch means mounted in said door path upstream of said carriage and activated by a leading edge of a door entering said path to actuate said door moving means to move said door past said grinding means.

3. The device in accordance with claim 2 further comprising second switch means mounted in said door path downstream of said carriage and actuated by a trailing edge of said door leaving said path to deactivate said moving means.

4. The device in accordance with claim 3 further comprising third switch means in said door path downstream of said first switch means and upstream of said first grinding means, said third switch means being operatively connected to said carriage moving means and said first and second grinding means.

5. The device in accordance with claim 4 further comprising fourth switch means in said door path downstream of said first grinding means and upstream of said second switch means, said fourth switch means being operatively connected to said carriage moving means to move said carriage away from said door.

6. The device in accordance with claim 1 wherein said carriage means is in substantial alignment with said first grinding means transverse to said bed.

7. The device in accordance with claim 1 wherein said second grinding means extends transversely beyond said carriage means and said limiting means includes rollers mounted to said carriage on opposite sides of said grinding means for engaging said door sidewall.

8. The device in accordance with claim 7 wherein each of said first and second grinding means includes a pivotally mounted grinding head and the axis of said grinding beads tapering to intersect at a point downstream of said carriage whereby said door is wedged between said grinding beads as it moves along said path.

* * * * *